United States Patent [19]

Suganami et al.

[11] 4,282,933

[45] Aug. 11, 1981

[54] AUTOMATIC CONTROL DEVICE FOR AN EARTH WORKING EQUIPMENT

[75] Inventors: Takashi Suganami, Fujisawa; Tashiro Takeda, Hiratsuka; Tetsuya Nakayama, Fujisawa; Koh Shimizu, Tokyo; Teruo Manseki, Fujisawa, all of Japan

[73] Assignee: Kabushiki Kaisha Komatsu Seisakusho, Tokyo, Japan

[21] Appl. No.: 46,179

[22] Filed: Jun. 7, 1979

[30] Foreign Application Priority Data

Feb. 2, 1978 [JP] Japan ..... 53/11298

[51] Int. Cl.[3] ..... A01B 63/111; E02F 3/76

[52] U.S. Cl. ..... 172/4.5; 172/7

[58] Field of Search ..... 172/2, 4, 4–5, 172/7; 37/DIG. 1, DIG. 19, DIG. 20; 404/84; 414/699, 700, 701; 56/10.2

[56] References Cited

U.S. PATENT DOCUMENTS

| | | | |
|---|---|---|---|
| 3,831,683 | 8/1974 | Ikeda et al. | 37/DIG. 20 X |
| 4,157,118 | 6/1979 | Sugami et al. | 172/7 X |
| 4,159,474 | 6/1979 | Wooldridge | 172/2 X |
| 4,166,506 | 9/1979 | Tezuka et al. | 172/4.5 |

FOREIGN PATENT DOCUMENTS

| | | | |
|---|---|---|---|
| 654084 | 12/1962 | Canada | 172/4.5 |
| 1290535 | 9/1972 | United Kingdom | 172/4.5 |

*Primary Examiner*—Richard T. Stouffer

*Attorney, Agent, or Firm*—Spensley, Horn, Jubas & Lubitz

[57] ABSTRACT

An automatic control device for an earth working equipment is directed to remove influence of acceleration on an inclinometer mounted on a vehicle body and thereby to effect an accurate blade control. An acceleration compensation arithmatic circuit receives outputs of a pair of inclinometer and removes an acceleration component by performing integration twice. This circuit is also designed to remove an integration error. Further, according to the invention, a Doppler radar system and an engine speed/throttle opening system are employed for detection of overload applied to the blade so that one of the detection systems which is most suitable for an actual work can be selected. Furthermore, the device includes both blade height controllers and tilt controllers and performs the two control operations most effectively. Response characteristics are improved by conducting the tilt control within a time interval during which the bade is in a holding state which time interval occurs in the control operation by the blade height controller.

8 Claims, 10 Drawing Figures

DRIVER
LOGIC CIRCUIT
DEAD ZONE SETTER
COMPA-RATOR
ENGINE SPEED
THROT-TLE
ONE SHOT
OIL TEMP.
WORK MODE CHANGE-OVER
ABSOLUTE VALUE
COMPEN-SATION
COMPA-RATOR
TIMER
ARITHMETIC CIRCUIT
ACCELERATION COMPENSATION
OVERLOAD DETECTION
AND1
AND2

AUTOMATIC CONTROL DEVICE FOR AN EARTH WORKING EQUIPMENT

BACKGROUND OF THE INVENTION

This invention relates to an automatic control device for earth working equipment.

When a grading or earth-pushing work is conducted with earth working equipment such as a bulldozer, it is necessary that the work is efficiently carried out without imposing overload to the vehicle body or the blade; however, in practice, it is difficult to do so.

In a conventional blade control method, a laser beam is emitted from a laser beam emitter set at a predetermined position of the vehicle, which has a reference height, and a laser beam receiver fixedly provided at a predetermined position of the blade or the like receives the laser beam thus emitted, thereby to obtain a height signal which is utilized to automatically control the height of the blade.

In another conventional blade control method, the bulldozer itself has a reference value, and the blade inclination angle is detected by means of a vertical gyroscope or an inclinometer, so that the blade height is automatically controlled in accordance with the difference between the detection value and the reference value.

However, the former method is disadvantageous in the following points: In a dusty place, or in a place where the ground vibrates, the laser beam is disturbed, and therefore the sufficient result cannot be obtained. In addition, the control device is considerably intricate, and accordingly, high in manufacturing cost.

The latter method is also disadvantageous in the following points: In the case where the vertical gyroscope is employed for the detection of the blade inclination angle, the vertical gyroscope itself is expensive, and is relatively low in durability against vibration. In the case where the inclinometer is employed, it is not expensive; however, it is affected by the acceleration and deceleration of the vehicle body. Therefore, when the vehicle speed is varied, it is impossible to control the blade.

In order to perform the blade control by detecting a load applied to the blade, a method is known in the art in which, for a wheel type vehicle such as motor grader or a motor scraper, the ratio in r.p.m. of the driving wheel to the driven wheel is detected to obtain a slip signal, which is utilized to control the vertical movement of the blade.

In this method, the detection is carried out after the load is increased to cause the driving wheel to slip. Therefore, the method is not applicable to a caterpillar type vehicle.

In the automatic blade control, the finish accuracy is greatly affected by the response speed. In the ordinary on-off control system, it is necessary to increase the dead zone to increase the response speed, but if the dead zone is increased, then hunting is caused. Therefore, in the ordinary on-off control system, the finish accuracy is lowered by increasing the response speed. Furthermore, in the ordinary on-off control system, it is necessary to decrease the response speed to increase the finish accuracy. Thus, the ordinary on-off control system suffers from the contradictory problem.

As is apparent from the above description, it is very difficult to automatically control the blade, and therefore almost all of earth working equipments such as bulldozers have no automatic blade control devices.

Accordingly, earth working operations such as those in pushing or leveling of earth are considerably difficult, and the operator must be highly skilled in the operation of the earth working equipment. As the working conditions are severe, the operator becomes considerably fatigued, which makes the work more difficult.

SUMMARY OF THE INVENTION

Accordingly, an object of this invention is to eliminate the above-described difficulties of the conventional blade control method.

It is another object of the invention to provide an automatic control device for an earth working equipment capable of controlling the blade with high accuracy without being affected by vibrations applied to the equipment.

It is another object of the invention to provide an automatic control device for an earth working equipment having two kinds of overload detection means and thereby being capable of detecting overload promptly.

It is still another object of the invention to provide an automatic control device for an earth working equipment capable of conducting a complex blade control by effectively performing a lifting and lowering control and a tilting control.

According to the invention, all of the blade height, the tilt angle, and the load reduction in the case of overload can be automatically controlled. Accordingly, it is unnecessary for the operator to have high operating technique, and the operator's fatigue can be reduced during the work. As two inclinometers are employed, the errors due to the acceleration caused at random can be eliminated, so that the inclination of the vehicle body can be accurately detected. Furthermore, the automatic control device is high in rigidity, high in accuracy, and low in manufacturing cost.

BRIEF DESCRIPTION OF THE DRAWINGS

The invention will now be described with reference to the accompanying drawings, wherein.

DETAILED DESCRIPTION OF THE INVENTION

One example of an automatic control device for earth working equipment according to this invention will be described with reference to the accompanying drawings in detail. For convenience in description, the earth working equipment is a bulldozer by way of example.

Figure 1:
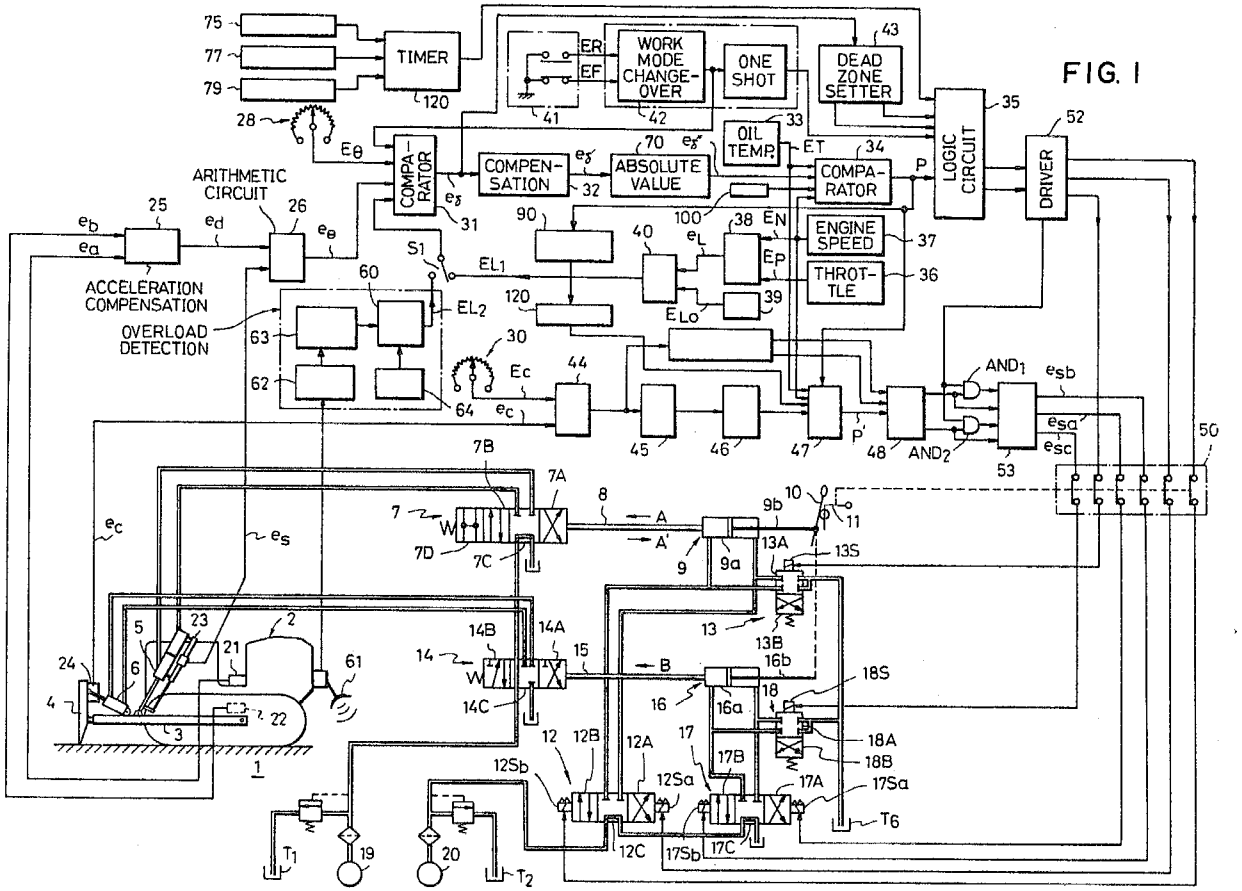
FIG. 1 is a block diagram of the control system of the present invention.

Referring to FIG. 1, a blade 4 is secured to the end of a blade supporting frame 3 the other end of which is rotatably supported on a body of a bulldozer 2. The blade 4 is moved up and down by a lift cylinder 5 disposed between the body and the blade supporting frame 3. The blade is tilted longitudinally by a tilt cylinder 6 provided between the blade 4 and the blade supporting frame 3. A direction switching valve 7 has four switching positions 7A through 7D to set the lift cylinder 5 to expanding, contracting, holding and floating positions. The valve 7 is connected through a rod 8 to the cylinder section 9*a* of an operating cylinder (hereinafter referred to as "a slave cylinder" when applicable) 9. The rod 9*b* of the slave cylinder 9 is connected to a manual operating lever 10. A lock mechanism 11 is to lock the operating lever 10 in the automatic blade control. The lock mechanism 11 is operated in association with a blade manual-automatic control change-over switch 50. That is, when the operating lever 10 is locked, the switch 50 is turned on; and when the operating lever 10 is released, the switch 50 is turned off. A three-position changeover electromagnetic valve 12 and a two-position change-over electromagnetic valve 13 (hereinafter referred to merely as "electromagnetic valves 12 and 13" when applicable) are provided to drive the slave cylinder 9. The electromagnetic valves 12 and 13 are connected to a hydraulic pressure circuit between the slave cylinder 9 and a hydraulic pressure pump 20, so that they are switched in response to output signals from a driver circuit 52. In the blade manual control, the valves 12 and 13 are switched to the positions 12C and 13A, respectively, as a result of which the slave cylinder 9 becomes hydraulically inoperative, i.e. oil is sealed in the cylinder 9 so that the cylinder 9 can be regarded as rigid body. The rod 8 follows movement of the rod 9*b*. Therefore, the operator can manually set the direction switching valve 7 to a predetermined switching position by using the operating lever 10.

In the automatic control operation, the operating lever 10 is locked by the lock mechanism 11, and accordingly the electromagnetic valve 12 expands or contracts the cylinder section 9*a* of the slave cylinder 9 with respect to the rod 9*b* according to the switching position 12A or 12B, thereby to set the direction siwtching valve 7 to a predetermined switching position. The electromagnetic valve 13 is provided for helping return of the direction siwtching valve 7 return by a spring. When the electromagnetic valve 13 is set to the position 13B, the bottom and head chamber thereof are communicated directly with a tank $T_6$, so that the slave cylinder 9 can operate freely.

Another direction switching valve 14 has three positions 14A, 14B and 14C to control the tilt cylinder 6, and it is connected to the cylinder section 16*a* of another slave cylinder 16 through a rod 15. The rod 16*b* of the slave cylinder 16 is coupled to the operating lever 10.

Electromagnetic valves 17 and 18 are provided to drive the slave cylinder 16. These electromagnetic valves 17 and 18 are connected to a hydraulic pressure circuit between the slave cylinder 16 and a hydraulic pressure pump 20 and are switched in response to output signals from a driver circuit 53, similarly as in the above-described electromagnetic valves 12 and 13. In the blade manual control operation, the electromagnetic valves 17 and 18 are switched to the positions 17C and 18A, respectively, as a result of which the rod 15 follows movement of the rod 16*b* in the same manner as has previously been described with regard to the slave cylinder 9. Accordingly, the operator can switch the direction switching valve 14 to a predetermined position by using the operating lever 10. In the blade automatic control operation, similarly as in the electromagnetic valve 12, the electromagnetic valve 17 expands and contracts the cylinder section 16*a* of the slave cylinder 16 with respect to the rod 16*b* according to the positions 17A–17C. Similarly as in the electromagnetic valve 13, the electromagnetic valve 18 is provided to help return of the direction switching valve 14 by a spring. When the electromagnetic valve 18 is set to the position 18B, the slave cylinder 16 is allowed to operate freely. These electromagnetic valves 13 and 18 are normally at the positions 13A and 18A, respectively. The electromagnetic valves 13 and 18 are switched to the positions 13B and 18B, respectively, when control signals which are outputted by the logic circuits 35 and 48 with the predetermined timing are applied through valve drive circuits 52 and 53 to solenoids 13S and 18S to energize the latter, respectively.

Inclinometers 21 and 22 are mounted on the upper part and the lower part of the body and along a vertical line which is extended near the center of gravity of the body The inclinometers 21 and 22 output signals $e_a$ and $e_b$ in response to an inclination of the body, respectively. The output signals are applied to an acceleration compensation arithmetic circuit 25. These inclination signals $e_a$ and $e_b$ include noise signals which are caused by the acceleration of the bulldozer 2 when the bulldozer 2 is moved forwards backwards, started or stopped.

In the acceleration compensation arithmetic circuit 25, the input signals $e_a$ and $e_b$ are subjected to addition and subtraction to obtain an angular acceleration signal in the direction of advancement of the body and a body inclination angle signal, and the inclination angle signal is subjected to integration twice to obtain an inclination value. The difference between the inclination value thus obtained and the inclination angle signal is obtained. The difference is fed back to the integration, thereby to completely eliminate the effects of the acceleration caused at random. Thus, the circuit 25 outputs an inclination angle signal $e_d$ corresponding to inclination of the body.

Figure 3:
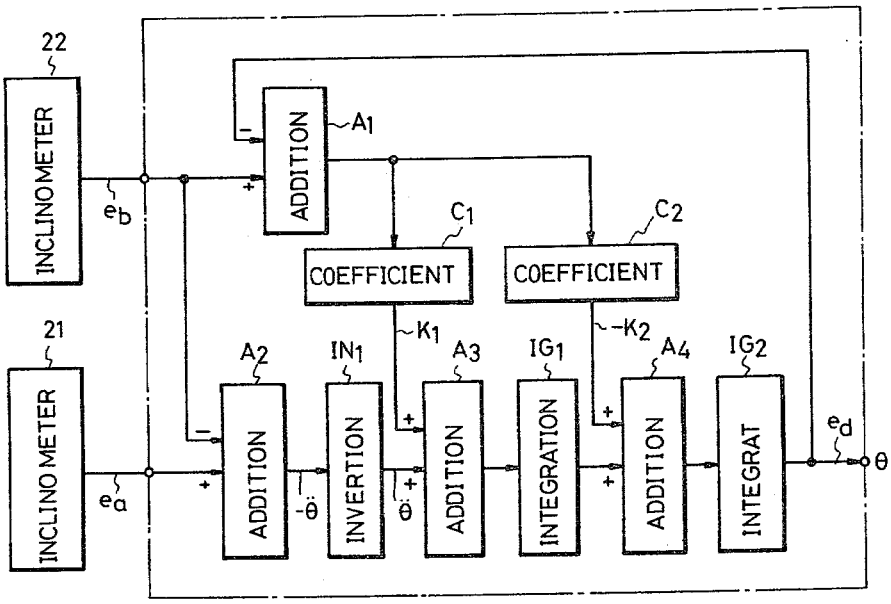
FIG. 3 is a block diagram of the acceleration compensation arithmetic circuit of FIG. 1.

The acceleration compensation arithmetic circuit 25 is illustrated in FIG. 3 in detail, which comprises addition circuits $A_1$ through $A_4$, integration circuits $IG_1$ and $IG_2$, an inverter $IN_1$, and coefficient units $C_1$ and $C_2$.

Figure 4:
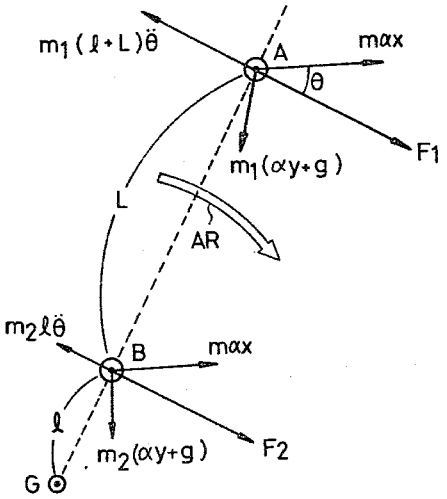
FIG. 4 is a diagram of forces exerted on a pair of inclinometers which form a part of the present invention.

The inclinometers 21 and 22 are equal in construction, and have weights A and B, respectively. When the weights A and B are turned around the centers G of gravity in the direction of the arrow AR, when forces applied to the weights A and B are expressed by vectors as shown in FIG. 4. In FIG. 4, $F_1$ and $F_2$ are the forces applied to the weights to bend the latter, $\alpha x$ and $\alpha y$ are the components in the X and Y direction of the acceleration applied to each weight, and m is the mass of each weight.

If the spring constant of each of the inclinometers 21 and 22 is expressed by K, and the amount of bend of the springs of inclinometers 21 and 22 in balance are expressed by $S_1$ and $S_2$, respectively, then $$F_1 = KS_1 = m\{\alpha x\cos\theta + (\alpha y + g)\sin\theta - (l + L)\ddot{\theta}\} \quad (1)$$
$$F_2 = KS_2 = m\{\alpha x\cos\theta + (\alpha y + g)\sin\theta - l \cdot \ddot{\theta}\} \quad (2)$$
$$\text{Therefore, } S_1 - S_2 = \frac{-mL}{K}\ddot{\theta} \quad (3)$$
$$S_2 = \frac{mg}{K}\left\{\sin\theta + \frac{1}{g}(\alpha x\cos\theta + \alpha y\sin\theta) - \frac{l}{g}\theta\right\} \quad (4)$$

The inclinometer 22 is near the center of gravity, and l/g is sufficiently small. Therefore the equation (4) can be rewritten in approximation as follows:

$$S_2 = \frac{mg}{K}\left\{\sin\theta + \frac{1}{g}(\alpha x\cos\theta + \alpha y\sin\theta)\right\} \quad (5)$$

$(1/g)(\alpha x \cos\theta + \alpha y \sin\theta)$ is the combination of the acceleration component and the gravity acceleration component, and therefore it can be regarded as a noise component (Nx) with respect to the inclination angle to be obtained.

$$\text{Therefore, } S_2 = \frac{mg}{K}(\sin\theta + Nx) \quad (6)$$

The inclinometers 21 and 22 output K/mL $S_1$ and K/mg $S_2$ as the electrical signals $e_a$ and $e_b$.

$$\text{Accordingly } e_a - e_b = -\ddot{\theta} \quad (7)$$
$$e_b = \sin\theta + Nx \quad (8)$$

The equation (7) is calculated by the addition circuit $A_2$. The value $\ddot{\theta}$ is obtained by inverting the result of the calculation by the inverter $IN_1$. This value is integrated twice to obtain the value. However, since integration error is caused in the integration operation, an arrangement has been made in the invention to correct the integration error. Furthermore, it goes without saying that correction is made to minimize the above-described noise component. Then, the calculation of the following equation (10) is carried out:

$$-\frac{1}{S}\left[K_2(\theta - \sin\theta) - \frac{1}{S}\{\ddot{\theta} + K_1(\sin\theta - \theta)\}\right] = \theta \quad (10)$$

As $\theta$ is small, $\sin\theta = \theta$. Therefore, $$\theta = \frac{\ddot{\theta}}{S} \quad (11)$$

Therefore, $\theta$ is independent of $K_1$ and $K_2$. In addition, the accumulation error in the integration can be substantially minimized. The value $-(1/S)$ is the transfer function of the integrator.

With respect to the noise component ($e_b$=Nx), the following calculation is carried out:

$$-\frac{1}{S}\left\{-\frac{K_1}{S}(N_X - \theta) - K_2(N_x - \theta)\right\} = \theta \quad (12)$$

The transfer function of the equation (13) can be sufficiently reduced by suitably selecting the values $K_1$ and $K_2$. That is, the effect of the noise component can be sufficiently reduced. Accordingly, the signal $e_d$ excellent in response characteristic and sufficiently free from the effect of the acceleration caused at random can be obtained.

A cylinder stroke detector 23 is juxtaposed with the blade cylinder 5, to detect the stroke of the blade cylinder 5 thereby to output a stroke signal $e_s$.

An inclinometer 24 is provided at a predetermined position on the rear surface of the blade 4, to detect the tilt angle of the blade 4 to output a tilt angle signal $e_c$.

An arithmetic circuit 26 receives the inclination angle signal $e_d$ of the body and the cylinder stroke signal $e_s$, to calculate the inclination angle of the blade supporting frame 3 thereby to output the corresponding inclination angle signal $e\theta$.

A frame inclination angle setter 28 is to set an inclination angle of the blade supporting frame 3, and outputs an inclination angle setting signal $E\theta$ corresponding to the set angle.

A tilt angle setter 30 operates to set a tilt angle of the blade 4, and to output a tilt angle setting signal $E_c$ corresponding to the set angle.

A throttle lever opening degree detector 36 detects a throttle lever opening degree to output a signal Ep.

An engine speed detector 37 detects a speed of the engine (not shown) to output an engine speed signal En.

An arithmetic circuit 38 receives the signals Ep and En to calculate a blade load thereby to output a load signal $e_L$.

A load setter 39 is to set a maximum load which can be applied to the bulldozer blade 4 according to working conditions, and it ouptuts a load setting signal $E_{LO}$ corresponding to the set load.

In an arithmetic circuit 40, the load signal $e_L$ is compared to the load setting signal $E_{L0}$, and when the signal $e_L$ exceeds the signal $E_{L0}$, i.e., when the blade 4 is overloaded, an overload signal $E_{L1}$ corresponding to the overload is outputted to comparator 31.

In this invention, an overload control operation employing a Doppler radar can be effected by operating a switch $S_1$. The overload control operation using the Dopper radar will be described.

The aforementioned Doppler radar 61 is provided on the bulldozer 2 in such a manner that its antenna forms a predetermined angle with a working surface. The Doppler radar 61 transmits a microwave to the working surface through the antenna and receives the reflected wave, thereby to output a frequency signal corresponding to the speed of the vehicle with respect to the ground. The frequency signal is applied through an amplifier 62 to a frequency-to-voltage converter circuit 63, where it is converted into a corresponding voltage signal. A critical speed setter 64 is to set the critical speed, that is, the lower limit value of speed at which the work can be carried out without causing failures such as slips or engine stops. During the earth working operation, as the blade 4 pushes earth, a large amount of earth is accumulated thereon, and accordingly the speed of the vehicle is reduced by the weight of the earth. If the vehicle is forcibly advanced under this condition, then the vehicle is overloaded, as a result of which the shoe slip or the engine stop is caused.

Therefore, in this invention, the lower limit of speed at which the work can be carried out without causing failures such as shoe slips and engine stops is set up by the critical speed setter 64 according to the qualities of soil and the running characteristics of the vehicle 2 for every using speed thereof. When the speed of the vehicle with respect to the ground falls below the critical speed during the work, it is determined that the vehicle is overloaded, so that the blade is lifted. Thus, the overload is eliminated before the failures occur.

One example of a method of determining the critical speed will be described.

Figure 6:
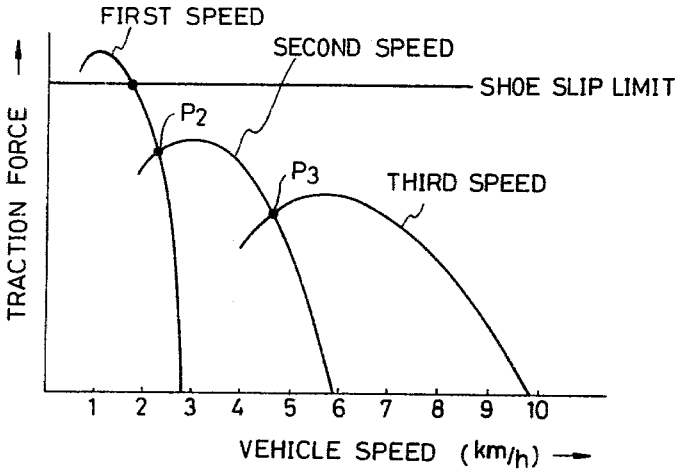
FIG. 6 is a graph of the running characteristics of a bulldozer.

Assume that the running characteristics of the bulldozer for its various speeds (the relation between the vehicle speeds and the traction forces) are as indicated in FIG. 6. In this example, it is considered that only at the first speed, the produced traction force exceeds the shoe slip limit, and at the other speeds no shoe slip is caused. Accordingly, for the first speed the above-described critical speed should be set to a speed (about 1.8 km/h in this example) slightly higher than the speed at which the shoe slip is caused, and for the second and third speeds it should be set to a speed slightly higher than the speed at which the engine stop is caused. However, taking the conditions into account that not only the engine stop should not be caused, but also the work should be conducted more efficiently, the critical speed for the second or third speed should be a speed at which the traction force is not greatly reduced and it is not greatly varied when the second or third speed is changed to the lower speed. More specifically, in the example shown in FIG. 6, the critical speed for the second speed should be a speed (about 2.3 km/h) at the intersection $P_2$ of the characteristic curve of the first speed and the characteristic curve of the second speed, and the critical speed for the third speed should be a speed (about 4.5 km/h) at the intersection $P_3$ of the characteristic curve of the second speed and the characteristic curve of the third speed. If the critical speeds are determined as described above, then not only can the work be done efficiently, but also the bulldozer is operated more economically. In other words, the work can be achieved with an improved fuel consumption rate by setting the critical speeds as described above, because the fuel consumption rate is worse with a speed at which the traction force is smaller, but is better with a speed at which the traction force is greater.

As the traction force at the shoe slip limit depends on the quality of soil, it is preferable that a necessary critical speed is determined for every work in advance by selecting a critical speed in a speed step exceeding the traction force.

The critical speed setter 64 may be one potentiometer. If, for the various speed steps, the corresponding ranges are marked on the speed scale (not shown) of the setter 64, then it is unnecessary to provide a potentiometer for every speed step; that is, it is possible to set up the critical speeds for all the speed steps with only one potentiometer.

Figure 5:
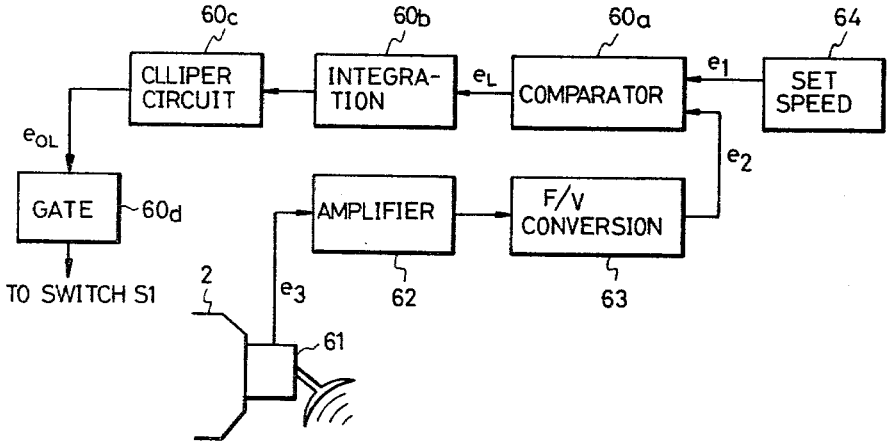
FIG. 5 is a block diagram of a Doppler overload control circuit used in the present invention.

A signal $e_1$ corresponding to the critical speed outputted by the critical speed setter 64 and a signal $e_2$ corresponding to the speed with respect the ground (hereinafter referred to as "a ground speed") outputted by the frequency-to-voltage conversion circuit 63 are applied to a comparator 60*a* in an arithmetic circuit 60 (FIG. 5). The comparator 60*a* outputs an overload signal $e_L$ when the ground speed becomes lower than the critical speed or the signal $e_2$ becomes smaller than the signal $e_1$ ($e_2<e_1$), i.e., when the blade 4 is overloaded. After being subjected to integration in an integrator 60*b*, the overload signal $e_L$ is applied to a clipper circuit 60*c*, where its upper portion is cut at a predetermined level, and the resultant overload signal $e_{OL}$ is applied through a gate circuit 60*d* and the switch $S_1$ to a comparator 31.

A forward and backward detector 41 is a switch operated in association with the forward and reverse change lever, and outputs signals EF and ER respectively in the forward run and the backward run, these signals EF and ER being applied to a work mode change-over switch 42. The switch 42 operates to place the blade in "lift" state automatically when the bulldozer 2 is moved forward or reversely.

Now it is assumed that the operator has locked the manual operating lever 10 with the lock mechanism 11, as a result of which the change-over switch 50 is turned on, and the blade 4 of the bulldozer 2 is under the automatic control. Furthermore, assume that the bulldozer 2 is moved forward at a speed V. In addition, it is assumed that the output E of the inclination angle setter 28, the output $E_c$ of the tilt angle setter 30, the output $e_\theta$ of the arithmetic circuit 26 and the output $e_c$ of the inclinometer 24 are maintained zero, and that the electromagnetic valves 13 and 18 are set to the positions 13A and 18A, respectively, and the direction switching valves 7 and 14 are set to the middle positions 7C and 14C, respectively, to hold the blade.

When the operator set the frame inclination setter 28 to, for instance, +3 degrees at the time instant $t_0$, then the setter 28 outputs a signal $E_\theta$ corresponding to +3 degrees. At this time instant, the signal $e_\theta$ is at 0 degrees. Accordingly, the comparator 31 outputs a difference signal $e\delta$ corresponding to the difference between these two signals $e_\theta$ and $E_\theta$, i.e., +3 degrees. This output is applied to a compensation unit 32. This compensation unit 32 delivers out a difference signal $e\delta'$ which is a sum of a signal obtained by proportionally calculating a signal $e\delta$ and a signal obtained by differentiating the signal $e\delta$. The signal $e\delta'$ is applied to an absolute value circuit 70. The differentiation characteristic is given to the difference signal $e\delta'$ to improve the characteristic of the control system. The circuit 70 delivers out a signal $e\delta''$ which represents an absolute value of the input signal $e\delta'$.

Figure 2:
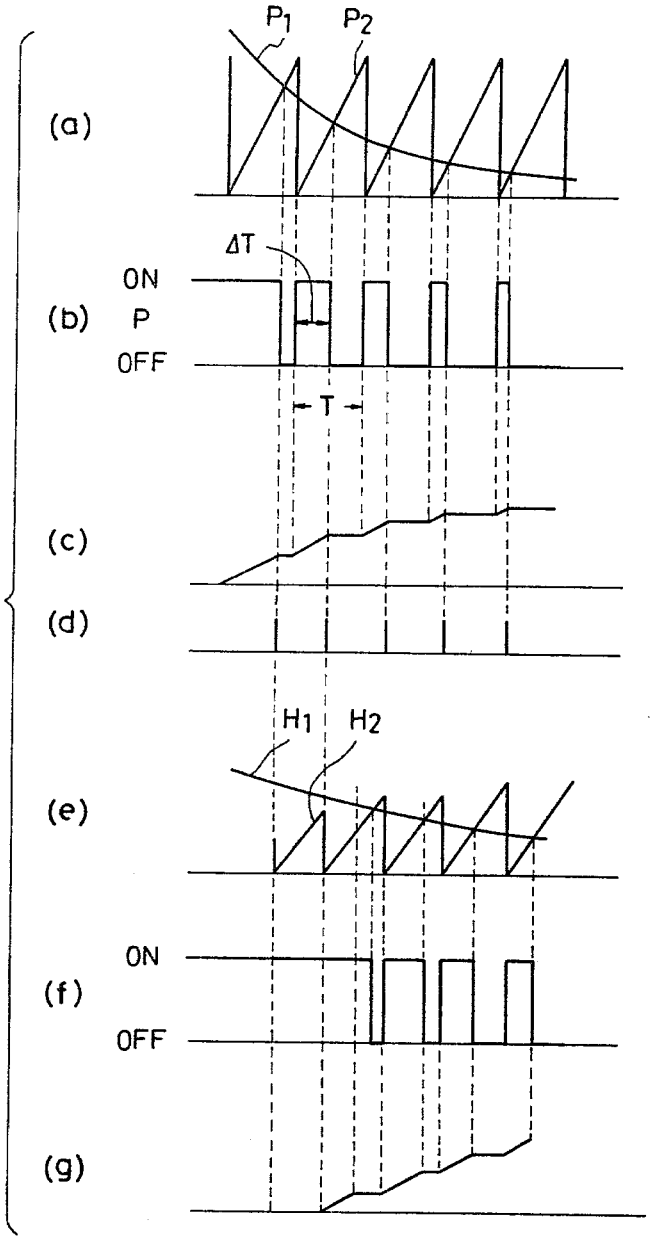
FIG. 2 is a timing diagram showing the outputs of various components of the control system.

The pulse control circuit 34 receives the difference signal $e\delta''$, the engine speed signal $E_N$ and the output signal $E_T$ of an oil temperature detector 33, to output a pulse signal P (FIG. 2 (*b*)) having a suitable period T according to the signal $E_N$ and having a pulse width $\Delta T$ proportional to the signal $e\delta''$, EN,ET. The signal P is applied to the logic circuit 35. This pulse signal P is a spool position instruction signal for the direction switching valve 7.

There are considered many methods of converting the input signal $e\delta''$, $E_T$ and $E_N$ into the pulse signal P having the period T and the pulse width $\Delta T$. However, in this case, the following method is employed by way of example. The difference signal $e\delta''$ will be expressed by $\epsilon(t)$ for instance.

First, an average pressurized oil flow rate $\overline{Q}$ supplied to the lift cylinder 5 when the spool of the direction switching valve 7 is operated by the pulse signal P having the period T and the pulse width $\Delta T$ will be roughly calculated. If an oil pressure pump 19 has its discharge quantity $Q_M$, then the average pressurized oil flow rate $\overline{Q}$ can be expressed by the following equation (1);

$$\overline{Q} = Q_M \cdot \frac{\Delta T}{T} \qquad (1)$$

If the oil temperature changes, the flow rate $\overline{Q}$ also changes due to change in the speed of slave cylinder. This change can be considered to be change in $\Delta T$ in the equation (1) due to the temperature change. The equation (1) therefore is converted to $$\overline{Q} = Q_M \frac{\Delta T f(th)}{T} \quad (2)$$

Where f(th) is a function of the oil temperature whose function form is determined by characteristics of the cylinder, the operation valve and the oil. Correction of the change in the flow rate Q can be achieved by calculating f(th), measuring the oil temperature and changing ΔT so that ΔT becomes $$\Delta T = \frac{K_2 \epsilon(t)}{f(th)} \quad (3)$$

Assuming that the oil pressure pump 19 is driven by the engine and that the discharge quantity $Q_M$ varies in proportion to the engine revolution number N, the above equation (1) is expressed by the following equation (4)

$$\overline{Q} = K_1 \cdot E_N \cdot \frac{\Delta T}{T} \quad (4)$$

where $K_1$ is a constant.

Accordingly, the pulse width ΔT can be corrected by a value obtained by detecting the engine revolution number N.

The comparator 34 outputs the pulse signal P (FIG. 2*b*) having period T and the pulse width ΔT proportional to the input signal.

The flow rate characteristic of the earth working equipment operation switching valve has a dead zone. If the speed or the idling time of the slave cylinder 9 is changed, then the flow rate in the lift cylinder 5 is changed even though the same pulse width signal is applied to the electromagnetic valve 12. The speed and the idling time of the slave cylinder 9 depend on the engine speed and the operating oil temperature. Therefore, the pulse width is corrected by applying the signals from the oil temperature detector 33 and an engine speed sensor 37 to comparator 34.

When the spool position instruction signal, i.e., the pulse width ΔT of the pulse signal P exceeds the dead zone signal $E_\Delta$ of a dead zone setter 43, the logic circuit 35 outputs a control signal Esa to energize the solenoid 12Sa of the electromagnetic valve 12, thereby to set the latter 12 to the position 12B. As a result, the slave cylinder 9 moves the rod 8 in the direction of the arrow A, whereby the direction switching valve 7 is set to the position 7A. When the direction switching valve 7 is completely set to the position 7A, the logic circuit 35 turns off the control signal Esa to deenergize the solenoid 12Sa, whereby the electromagnetic valve 12 is set to the middle position. Thus, the slave cylinder 9 is held at that position, and the direction switching valve 7 is held at the spool position 7A. Accordingly, the lift cylinder 5, being supplied with the pressurized oil from the hydraulic pump 19, is contracted, whereupon the blade supporting frame 3 is turned upwardly to move the blade 4 upwardly.

The arithmetic circuit 26 outputs an inclination signal eθ according to the inclination of the blade supporting frame 3. This signal is applied to the comparator 31.

When the pulse signal P becomes to the zero level to make an instruction to hold the blade, then the logic circuit 35 outputs a control signal Esb to energize the solenoid 12Sb of the electromagnetic valve 12 thereby to set the latter 12 to the position 12A. Accordingly, the slave cylinder 9 is contracted to move the rod 8 in the direction of the arrow A', thereby to move the direction switching valve 7 towards the middle position 7C. Then, at the time instant when the direction switching valve 7 has been moved in the spool neutral direction for a predetermined period of time or as much as a predetermined distance, the driver circuit 52 sets the control signal Esb to the zero level, and simultaneously outputs a control signal Esc to energize the solenoid 13S of the electromagnetic valve 13, thereby to set the latter to the position 13B. Accordingly, no pressurized oil is supplied to the slave cylinder 9, and simultaneously the bottom chamber and the head chamber are connected directly to the tank $T_6$ by the electromagnetic valve 13, as a result of which the slave cylinder 9 is set free. Therefore, the direction switching valve 7 can returned exactly to the middle position 7C by the restoring force of the return spring. When the direction siwtching valve 7 has returned to its middle position 7C, the logic circuit 35 and the driver circuit 52 sets the control signal Esc to the zero level to deenergize the solenoid 13S, thereby to set the electromagnetic valve 13 to the position 13A. Accordingly, the salve cylinder 9 is held at the position, and the direction switching valve 7 is locked at the middle position 7C. Thus, the blade is held at that position.

The blade 4 is gradually lifted by repeatedly carrying out the above-described controls in succession. When the inclination angle of the blade supporting frame 3 reaches the preset angle +3 degrees, then the difference signal eδ from the comparator 31 become the zero level, and the control system is placed in stable state. Thus, the control of moving the blade 4 upwardly has been accomplished.

If the load of the blade 4 is increased and the arithmetic circuit 40 or 60 outputs the overload signal $E_{L1}$ or $E_{L2}$ during the earth working operation which is conducted while the blade 4 is automatically controlled to a predetermined height, then the comparator 31 outputs the difference signal eδ [$e\delta = E\theta - e\theta + E_{L1}$ (or $E_{L2}$)]. According to the difference signal eδ'', the signal $E_T$ and the signal $E_N$, the comparator 34 outputs the pulse signal P having the period T and the pulse width ΔT. As shown in FIG. 2(*a*), the comparator 34 compares saw-tooth wave signal $P_2$ from the saw-tooth wave circuit 100 with the output P of the absolute value circuit 70 and produces a pulse ¹signal (FIG. 2(*b*)) which is at a high level when the signal $P_2$ is larger than the signal $P_1$ and at a low level when the signal $P_2$ is smaller than the signal $P_1$. Although the signal $P_1$ is changed further in accordance with the signals $E_T$ and $E_N$, this change is omitted in FIG. 2(*a*). In response to the pulse signal P and the dead zone signal from the dead zone setter 43, the logic circuit 35 and the drive circuit 52 output the control signals Esa, Esb and Esc with the predetermined timing, to drive the direction switching valve 7 to operate the lift cylinder 5 whereby the blade 4 is lifted to reduce the over load. As the load is reduced, the overload signal $E_L$ is decreased, as a result of which the blade 4 lifting speed is decreased. Thus, when the overload signal $E_L$ becomes the zero level, the blade 4 is stopped at that position. When the blade load is reduced to less than the overload, the blade 4 is controlled in accordance with the above-described inclination setting signal Eθ. That is, the blade 4 is automatically controlled so that its height is equal to or closes to a value corresponding to the predetermined inclination setting angle $E\theta$.

Figure 8:
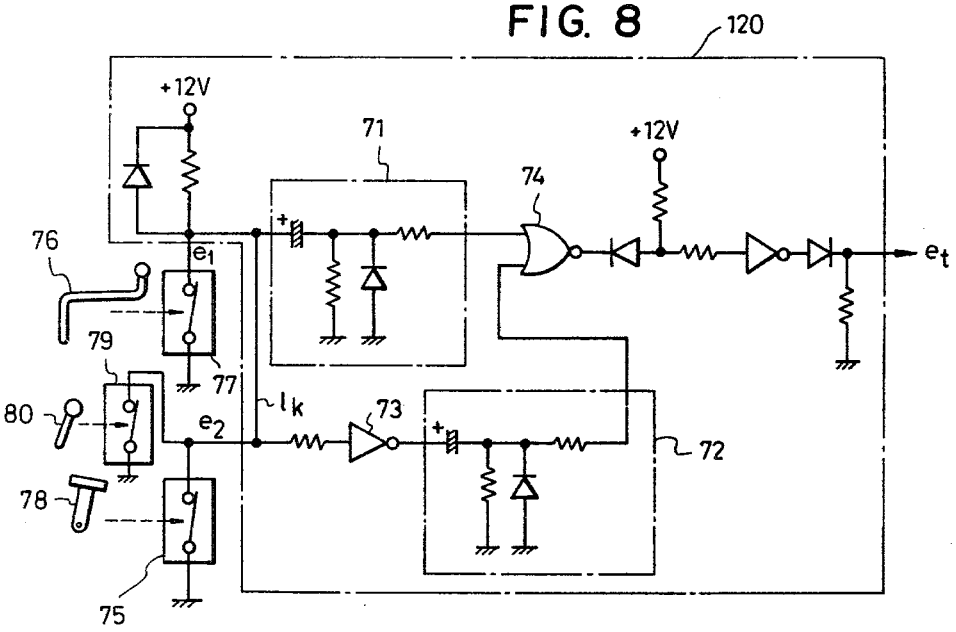
FIG. 8 is a block diagram of a timer circuit used to control the operation of the control system of the present invention.

Referring to FIG. 8, a timer circuit 120 comprises two time constant circuits 71 and 72 which are equal in time constant. The inputs of the time constant circuits 71 and 72 are connected to a line lk. The outputs thereof are connected to a NOR circuit 74. The time constant circuit 71 is so designed that the rise of a signal applied to the line lk is subjected to differentiation, thereby to output a signal "1". The arrangement of the time constant circuit 72 is equal to that of the time constant circuit 71. An inverter 73 is connected to the input of the time constant circuit 72. Therefore, in the time constant circuit 72, the fall of the signal is applied to the line lk to output a signal "1". Position detectors 77, 75 and 79 are, for instance, limit switches, which are turned off when an operating lever 76 is pulled, or a brake pedal 78 is depressed, or a clutch lever 80 is pulled, and which are in "on" state when not operated. Accordingly, when the operating lever 76, the brake pedal 78 or the clutch lever 80 is operated, the signal introduced to the line lk is raised to "1". In the time constant circuit 71, this rise is subjected to differentiation and its output level is maintained at "1" for a predetermined time T. When the operating lever 76, the brake pedal 78 or the clutch lever 80 is restored, the signal on the line 1 is lowered to "0". In the time constant circuit 72, this fall is differentiated, and its output is maintained at "1" for a predetermined period T. The outputs of the two time constant circuits 71 and 72 are applied to the NOR circuit 74. The output of the NOR circuit 74 is inverted. As a result, the timer circuit 70 outputs an inhibit signal $e_t$ which is maintained at "1" for the predetermined period T in synchronization with the starting or ending time instant of the operation of the operating lever 76, the brake pedal 78 or the clutch lever 80.

Figure 7:
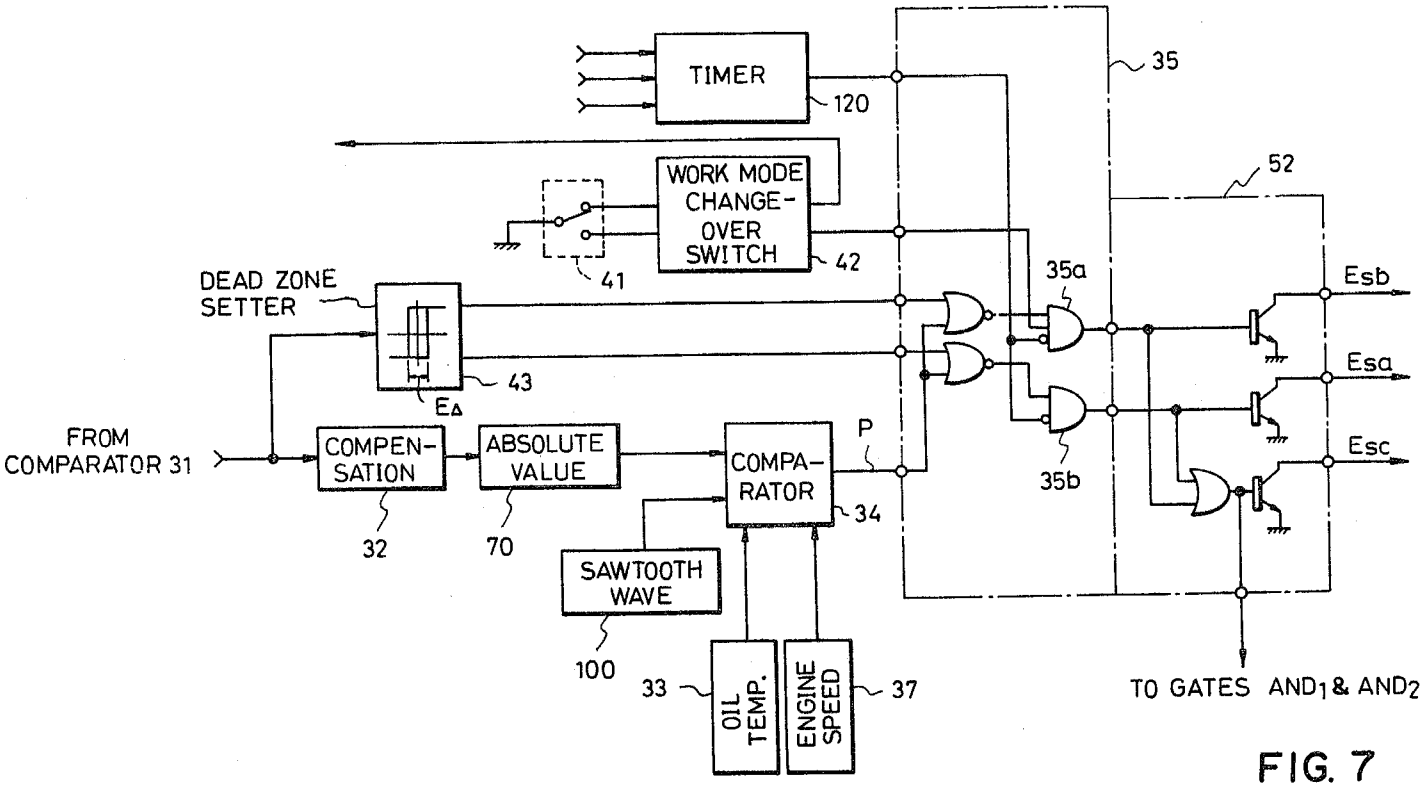
FIG. 7 is a block diagram of a circuit for generating frame inclination correction signals.

The logic circuit 35 has AND circuits 35*a* and 35*b* as shown in FIG. 7. When the AND circuits 35*a* and 35*b* are disabled by the signal from the timer circuit 120, the conduction of the pulse signal P is interrupted. Therefore, the electromagnetic valve 12 is not driven (being set at the neutral position) but the electromagnetic valve 13 is driven. Accordingly, the blade is held at the position which is obtained immediately before the logic circuit 35 is disabled (off), i.e., immediately before the operating lever 76, the brake pedal 78 or the clutch lever 80 is operated.

Figure 9:
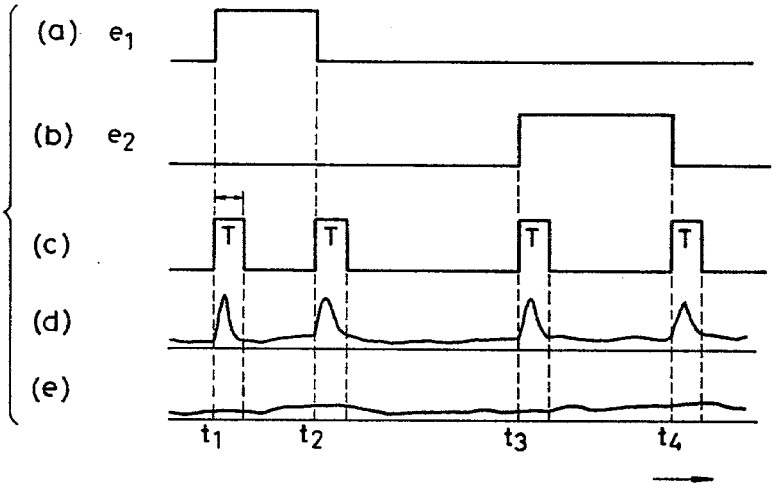
FIG. 9 is a timing diagram showing the operation of the circuit of FIG. 8.

Assume that the operating lever 76 is operated from the time instant $t_1$ to the time instant $t_2$ in FIG. 9 so that the output signal $e_1$ of the position detector 77 is maintained at "1" for this period only as indicated in the part (a) of FIG. 9, and the brake pedal 78 is operated from the time instant $t_3$ to the time instant $t_4$ so that the output signal $e_2$ of the position detector 75 is maintained at "1" for this period only as indicated in the part (b) of FIG. 9, the same thing being effected for the output signal of the position detector 79. In this case, the acceleration (negative acceleration) of the vehicle body is increased at the start and end of each of the above-described operations. As a result, the output signal of the acceleration compensation arithmetic circuit 25 is temporarily increased as shown in the part (d) of FIG. 9 although the actual inclination angle $\theta$ is is not so greatly changed. As was described above, the acceleration effect can be eliminated greatly by the circuit 25; however, it is difficult to completely eliminate the acceleration effect.

If the blade is controlled in accordance with the detection values of the inclination detectors 21 and 22 at the start and end of the operation similarly as in the ordinary running period, then the blade 4 is moved up and down even though the actual inclination is maintained unchanged. However, the inhibit signal $e_t$ is maintained at "1" for the predetermined period T (1 to 2 seconds for instance) in synchronization with the start time ($t_1$ or $t_3$) and the end time ($t_2$ or $t_4$) of each operation as shown in the part (c) of FIG. 9, and the logical circuit 35 is disabled. Therefore, the electromagnetic valve 12 is not operated (being at the neutral position). As a result, the frame angle is held at the value which is obtained immediately before the operation is started or ended. Thus, the blade will never move up and down by the acceleration effect.

As is clear from the above description, the blade angle with respect to the vehicle body is maintained at the value obtained immediately before the operation is started or ended, for one or two seconds after the operation of the operating lever or the brake pedal is started or ended causing the acceleration. Therefore, it is possible to prevent the height of the blade from being changed by the acceleration effect. Furthermore, even if the height of the blade is at a value different from the set value by external disturbance, the blade is held at that height for a very short time. Therefore, the excavation is scarcely affected by this irregular height of the blade.

The valve drive circuit 52 delivers the outputs Esa, Esb and Esc, to drive the electromagnetic valves 12 and 13 and the slave cylinder 9, to operate the direction switching valve 7, whereby the blade 4 is lifted to a predetermined height.

Now, the blade tilt angle automatic control will be described.

This automatic control is carried out substantially similarly as in the blade height control described above.

It is assumed that, under the condition that the blade is held horizontally, the operator has set the lift angle setter so that the blade will be tilted by 5 degrees downwardly on the left side as viewed from the operator.

Then, the tilt angle setter 30 outputs a tilt signal Ec corresponding to the set angle 5 degrees. The signal Ec is applied to the comparator 44. On the other hand, the output $e_c$ of the inclinometer 24 is at the zero level because the blade 4 is horizontal. The comparator 44 outputs a difference signal $e\beta$ corresponding to the difference between the signal $E_c$ and $e_c$. The difference signal $e\beta$ is applied to a compensator 45. Similarly as in the compensator 32, the compensator 45 outputs a signal $e\beta'$ which is obtained by adding a signal obtained by proportional calculation of the input signal and a signal obtained by differentiating the input signal. The signal $e\beta'$ is applied to an absolute value circuit 46.

Similarly as in the pulse control circuit 34, a pulse control circuit 47 outputs a pulse signal P' in response to the signal $e\beta'$ and the signal $E_N$. This pulse signal P' has a period $T_1$ and a pulse width $\Delta T_1$ similarly as in the case of the above-described pulse signal P, and it is the spool position instruction signal of the direction switching valve 14. A logic circuit 48 provides its output when the spool position instruction signal, or the pulse width $\Delta T_1$ of the pulse signal P', exceeds the dead zone signal $e\Delta$ of a dead zone setter 49. Therefore, a valve drive circuit 53 outputs a control signal $e_{sa}'$ to energize the solenoid $17S_a$ of the electromagnetic valve 17, thereby to set the latter 17 to the position 17B. Accordingly, the slave cylinder 16 is expanded to move the rod 15 in the direction of the arrow B, whereby the direction switching valve 14 is switched to the position 14A. When the direction switching valve 14 is completely set to the position 14A, the control signal $e_{sa}$ from the valve drive circuit 53 is turned off to deenergize the solenoid 17Sa, whereby the electromagnetic valve 17 is set to the middle position 17C. As a result, the slave cylinder 16 is held at that position, and the direction switching valve 14 is held at the position 14A. Therefore, the tilt cylinder 6, being supplied with the pressurized oil from the hydraulic pump 19, is contracted, as a result of which the blade 4 is tilted so that the left end is lower.

The inclinometer 24 outputs the inclination signal $e_c$ in response to the inclination of the blade 4. The inclination signal $e_c$ is applied to the comparator 44.

When the pulse signal P' is set to the zero level, then the valve drive circuit 53 outputs a control signal $e_{sb}$ to energize the solenoid 17$S_b$ of the electromagnetic valve 17, whereby the latter 17 is set to the position 17B. Accordingly, the slave cylinder 16 is contracted to move the rod 15 in a direction opposite to the direction B, whereby the direction switching valve 14 is moved towards the neutral position 14C. When the direction switching valve 14 has been moved towards the neutral position for a predetermined period of time or as much as a predetermined distance, the logic circuit 48 and the valve drive circuit 53 set the control signal $e_{sb}$ to the zero level to set the electromagnetic valve 17 to the middle position 17C, and simultaneously output a control signal $e_{sc}$ to energize the solenoid 18S of the electromagnetic valve 18 thereby to set the latter to the position 18B. Accordingly, the supply of the pressurized oil to the slave cylinder 16 is suspended, and simultaneously the bottom chamber and the head chamber are connected directly to the tank $T_6$ by the electromagnetic valve 18. As a result, the slave cylinder 16 is set free. Accordingly, similarly as in the direction switching valve 7, the direction switching valve 14 is returned exactly to the neutral position 14C by the restoring force of the return spring.

When the direction switching valve 14 is returned to the neutral position 14C, the logical circuit 48 and the valve drive circuit 14 set the control signal $e_{sc}$ to the zero level to deenergize the solenoid 18S, so that the electromagnetic valve 18 is set to the position 18A. Thus, the slave cylinder 16 is held at that position, and the direction switching valve 14 is locked at the neutral position 14C, so that the blade 4 is held at that inclination angle.

The above-described controls are repeatedly carried out to gradually tilt the blade 4. When the tile angle of the blade 4 reaches the set angle 5°, the difference signal $e\beta$ from the comparator 44 is set to the zero level. Thus, the tilt angle control of the blade 4 has been accomplished.

The tilt angle of the blade 4 can be controlled so that the right end is lower, in a manner similar to the above-described one.

In this case, similarly as in the above-described control for lifting the blade, as the tilt angle reaches the set angle, the speed of the blade is gradually reduced. Therefore, the blade tilt angle can be set at the set value without causing hunting or the like.

In conducting an automatic control of a blade of a bulldozer both in a lifting and lowering direction (i.e. upward and downward direction) and in a tilting direction (i.e. leftward and rightward direction), a desired earth grading accuracy cannot be obtained if the same control system as the control system for the lifting and lowering direction is simply applied to the control system for the tilting direction. The reason is stated below.

Since a bulldozer normally has only one system of hydraulic circuit and, accordingly, a lift cylinder and a tilt cylinder cannot be operated simultaneously but a predetermined one of either a lift cylinder operation valve or a tilt cylinder operation valve is preferentially operated. Such limitation inherent in the hydraulic system of a bulldozer must be taken into consideration in the control device of the present invention, for if the oil is flowing in one actuator, it does not flow in another however great the difference between a preset value and a detected value may be. Accordingly, if a difference value of the tilting system and that of the lifting and lowering system are respectively compared with corresponding saw-tooth waves to obtain pulse width signals and electromagnetic valves are switched on and off by such pulse width signals, one of the tilting system and the lifting and lowering system which is not given priority is limited in its operation by the operation of the other system which is given priority and there occurs in the one system a time interval during which response cannot be made. This decreases the response characteristic of that system resulting in decreasing in accuracy of the earth grading operation.

In the hydraulic system of a bulldozer, priority is normally given to the tilting system. Higher control performance however is required for the lifting and lowering system than for the tilting system. According to the present invention, priority is given to the control of the lifting and lowering system and the control of the tilting system is conducted only while the lifting and lowering control is not conducted. More specifically, an integration circuit of the tilting system is reset by fall of a pulse signal for driving the valve 12 to initiate integration so that a pulse for driving the valve 12 is immediately outputted when there occurs a difference. Thus, a time interval during which the tilting system is not operated is effectively utilized so that the response characteristic is improved. It is to be noted that a drive signal for the tilting system is not generated while the lifting and lowering system is in operation.

Figure 10:
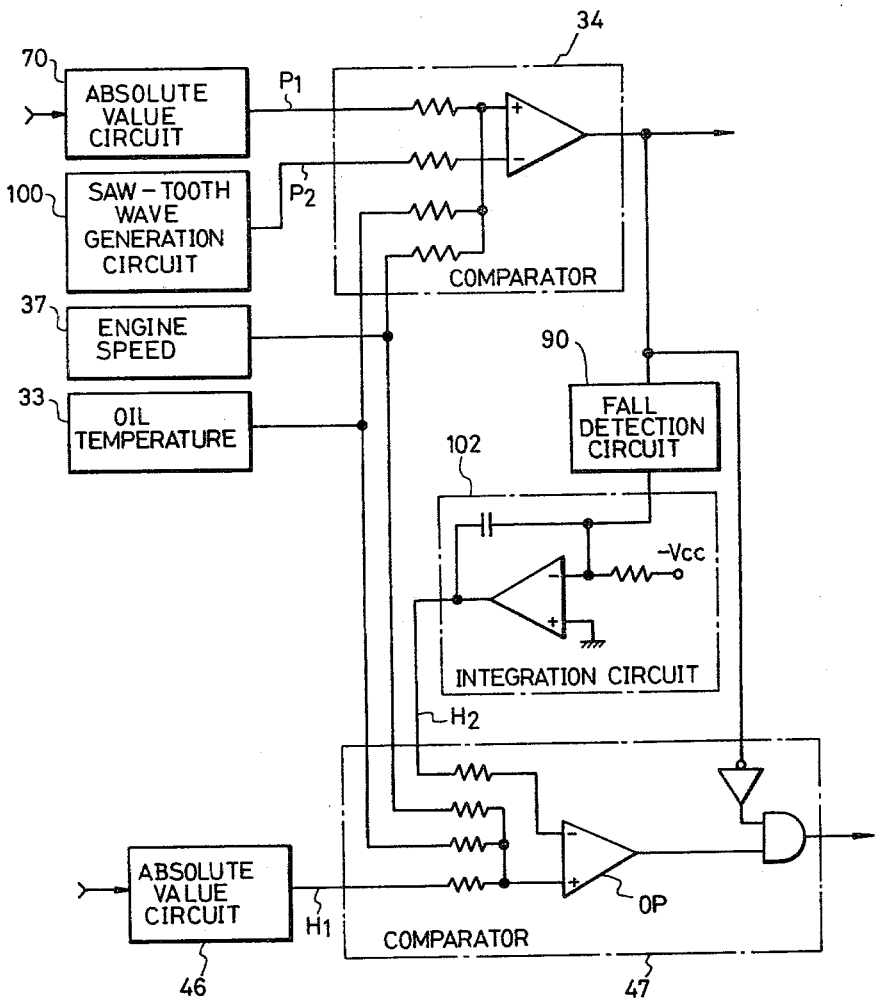
FIG. 10 is a portion of the control circuitry which controls the interrelation between tilt and lift operations performed by the control system of the present invention.

The interrelation between the tilting operation and the lifting and lowering operation will now be described with reference to FIGS. 2(*a*) through 2(*g*) and FIG. 10. For convenience of explanation, it is assumed that the engine speed and the oil temperature remain constant.

Referring to FIG. 2(*a*), if the output of the absolute value circuit 70 varies as shown in curve $P_1$, a pulse with a larger pulse width is generated if the level of the pulse is higher as shown in FIG. 2(*b*). Accordingly, the cylinder stroke of the lift cylinder 5 gradually increases as shown in FIG. 2(*c*). When the level of the pulse P is 0, the stroke of the lift cylinder does not change but remains as it is.

The tilting control is conducted while the stroke of the lift cylinder remains unchanged. The output of the comparator 34, i.e. pulse P, is applied to a fall detection circuit 90 which thereupon produces a trigger signal as shown in FIG. 2(*d*). This trigger signal is applied to an integration circuit 102. This circuit 102 generates a saw-tooth wave signal as shown in FIG. 2(*e*) by starting integration by this trigger pulse. The period of this saw-tooth wave signal is determined by the trigger signal. If the output of the absolute value circuit 46 is as shown by $H_1$ in FIG. 2(*e*), the output pulse from the operational amplifier OP of the comparison circuit 47 is as shown by FIg. 2(*f*). This output is applied to one of input terminals of AND gate AD. To the other input of the AND gate AD is applied the output of the comparator 34 through an inverter. Accordingly, the stroke of the tilt cylinder 6 is controlled as shown in FIG. 2(*g*). In other words, stroke of the tilt cylinder 6 is controlled only while the lift cylinder 5 of the tilt cylinder 6 is not in operation, i.e. in a holding state. The operation time of the tilt cylinder 6 varies with the level of the output of the absolute value circuit 46. The tilt cylinder 6 is maintained in a holding state unless it is in operation.

As described in the foregoing, the tilt control is not conducted while the lifting and lowering control is in operation. For ensuring this, AND circuits $AND_1$ and $AND_2$ (FIG. 1) are provided between the logic circuit 48 and the valve drive circuit 53.

That is, in the case where any lift control is effected, the valve drive circuit 52 outputs a lift priority signal which is applied to the inhibit inputs of the AND circuits $AND_1$ and $AND_2$. Therefore, the output signal from the logic circuit 48 is interrupted, and the tilt control is not carried out.

What is claimed is:

1. An automatic control device for an earth working equipment comprising:

a pair of inclinometers provided at upper and lower parts of a body of the equipment for outputting inclination signals corresponding to inclination of the body;

an acceleration compensation arithmetic circuit for substantially removing an acceleration component contained in the inclination signal and outputting an inclination angle only;

means for detecting a stroke of a cylinder for lifting and lowering a frame supporting a blade;

an arithmetic circuit for calculating a present inclination angle of the frame in accordance with the inclination angle and the cylinder stroke; and blade control means for controlling the blade in response to difference between the present inclination angle of the frame and a reference value.

2. An automatic control device for an earth working equipment as defined in claim 1 wherein said acceleration compensation arithmetic circuit comprises:

a first addition circuit receiving outputs of the pair of inclinometers provided on the upper and lower parts of the body and adding the output of the upper inclinometer and an inverted signal of the output of the lower inclinometer together;

first and second integration circuits;

a second addition circuit for adding an inverted signal of the output of said second integration circuit and the output of the lower inclinometer together;

first and second coefficient units for multiplying the output of said second addition circuit with predetermined constants;

a third addition circuit for adding the output of said first coefficient unit and an inverted signal of the output of said first addition circuit together and supplying a result of the addition to said first integration circuit as an integration input; and a fourth addition circuit for adding the output of said first integration circuit and the output of said second coefficient unit together and supplying a result of the addition to said second integration circuit as an integration input.

3. An automatic control device for an earth working equipment as defined in claim 1 further comprising overload detection means for detecting overload applied to the blade which overload detection means includes:

a Doppler radar mounted on the body;

a converter circuit for converting a frequency signal corresponding to a speed of the equipment with respect to the ground to a voltage signal;

a circuit for setting a lower limit value of a critical speed; and a comparison circuit for comparing the value of the voltage signal with the lower limit value of the set critical speed and delivers out an overload signal when the voltage signal has fallen below the set value.

4. An automatic control device for an earth working equipment as defined in claim 3 which further comprises, in addition to said Doppler radar type overload detection means, an overload detection means which includes:

a detector for detecting a throttle lever opening:

a detector for detecting an engine revolution number; and an arithmetic unit for calculating a ratio of the throttle lever opening and the engine revolution number and delivering out an overload signal when this ratio has exceeded a preset value;

and which further comprises a switch for selecting either one of said overload detection means.

5. An automatic control device for an earth working equipment as defined in claim 1 wherein said blade control means comprises:

a pulse control circuit for generating a pulse of a polarity corresponding to the polarity of the difference value between the present inclination angle of the frame and the reference value or to the polarity of an overload signal and of a pulse width corresponding to the difference value;

a logic circuit for generating a blade lifting or lowering signal and a blade hold signal;

a first three-position electromagnetic valve changed over by the blade lifting or lowering signal;

an operation cylinder connected at the head side thereof to a rod of a direction change valve which changes the direction of hydraulic oil flow to a blade lifting cylinder and connected at the rod thereof to a manually operated lever, said operation cylinder being controlled by the hydraulic oil flow from said first electromagnetic valve; and a second electromagnetic valve for returning said direction change valve to a neutral position by releasing the hydraulic pressure in said operation cylinder in response to said blade hold signal.

6. An automatic control device for an earth working equipment as defined in claim 5 further comprising:

detection means for detecting actuation and return of the operation lever, a brake pedal and a clutch pedal;

a timer for delivering out a signal for a predetermined period of time from the detection by said detection means; and means for inhibiting said blade lifting or lowering signal in response to the signal from said timer thereby to hold the blade in a position immediately before the detection.

7. An automatic control device for earth working equipment and a blade for said earth working equipment, said control device comprising:

blade control means for controlling lifting and lowering of the blade in accordance with a difference between the present height and a preset height of the blade;

tilt angle control means for controlling a tilt angle of the blade in accordance with a difference between the present tilt angle and a preset tilt angle, said tilt angle control means including an inclinometer coupled directly to the blade to detect the tilt angle of the blade; and blade preference means for inhibiting an operation of said tilt angle control means while the blade is being lifted or lowered and enabling the operation of said tilt angle control means while the blade is not being lifted or lowered.

8. An automatic control system for use in earth working equipment of the type which includes a body, a movable frame coupled to the body and a blade carried on the frame, said control system comprising:

inclinometer means for providing at least one inclination signal corresponding to the inclination of the body, wherein said at least one inclination signal includes an unwanted acceleration component caused by movement of the body;

an acceleration compensation arithmetic circuit connected to the inclinometer means for substantially removing said acceleration component to thereby provide an output signal which is substantially a function of body inclination alone;

detection means for providing an output corresponding to the angle of the frame with respect to the body;

an inclination arithmetic circuit for receiving the outputs of the acceleration compensation circuit and the detection means and for calculating a present inclination angle of the frame with respect to the ground; and blade control means for controlling the position of the blade in response to the difference between the present inclination angle and a reference value.

* * * * *